United States Patent [19]

Chiu

[11] 4,022,137

[45] May 10, 1977

[54] SAFE WITH HYDRAULIC SAFETY PROTECTION

[76] Inventor: Tsuen Mu Chiu, No. 304, Wu Fong N. Road, Chia-ih, Taiwan, China /Taiwan

[22] Filed: June 16, 1975

[21] Appl. No.: 586,915

[52] U.S. Cl. ..... 109/44; 109/47; 137/384.4

[51] Int. Cl.[2] ..... E05G 1/10

[58] Field of Search ..... 109/38, 47, 44, 58, 109/59; 70/242, 243; 137/384.4

[56] References Cited

UNITED STATES PATENTS

| | | | |
|---|---|---|---|
| 695,360 | 3/1902 | Abbott | 109/47 |
| 1,548,282 | 8/1925 | Reinhart et al. | 109/47 |
| 1,559,370 | 10/1925 | Postemsky | 70/242 X |
| 1,584,294 | 5/1926 | Heise | 109/47 |
| 3,059,596 | 10/1962 | Pretini | 109/38 |

FOREIGN PATENTS OR APPLICATIONS

| | | | |
|---|---|---|---|
| 106,514 | 6/1965 | Norway | 137/384.4 |
| 96,881 | 9/1939 | Sweden | 109/47 |

*Primary Examiner*—Paul R. Gilliam

*Assistant Examiner*—David H. Corbin

*Attorney, Agent, or Firm*—Cushman, Darby & Cushman

[57] ABSTRACT

A safe for protecting valuables such as jewelry with an outer casing having an open top and an inner casing for receiving the valuables. A hydraulically operated, mechanical linkage within the outer casing mounts the inner casing for movement by the application of hydraulic force between a lower and elevated position. First and second locks are disposed in the hydraulic path which elevates the inner casing and each include a rotatable annular element and a second element rotatable therein, each element having a passage therethrough so that the hydraulic elevating path is completed when the passages are aligned by choice of the correct combination. At least one of the elements includes a drain path for releasing the hydraulic pressure to lower the inner casing. An alarm coupled to the hydraulic path sounds whenever pressure greater than a given value is detected indicating that pump has been operated without the locks being in the correct positions.

2 Claims, 12 Drawing Figures

SAFE WITH HYDRAULIC SAFETY PROTECTION

Most conventional safes can be opened and their contents stolen. As the criminal "technique" advances and theft increases, it becomes very difficult very difficult to protect one's properties.

Jewelry shops generally collect their displayed jewelry for storage in the evening the prevent them from being stolen. However, this procedure is complex and inconvenient. It's also dependent on the safety of the storage place. The present inventor discloses a preferred safe for storing precious materials such as jewels.

SUMMARY OF THE INVENTION

In accordance with the present invention, an improved safe has been proposed which provides the following nature and advantages:

a. The casing can be shaped in many forms such as long type, round or L type. The casing top allows the descending & rising of the inner case. A rotary number dial is set on the side of the casing. When the dial is turned to a specific number where the internal hydraulic oil can be running & passed, the inner case can then be elevated to a stable state actuated by hydraulic oil driven by an electrically starting hydraulic oil pump. This will allow someone to remove or deposit something to or from the safe. After taking out or depositing something, one can turn the dial to another mark to allow the oil to be released. The inner case will the descend by gravity. Then, the dial is optionally adjusted to make it confused which is beneficial for locking use.

b. The safe is constructed of steel plate, asbestos and casting iron. It is difficult for it to be damaged by drill, chisel or gas cutting by thieves.

c. The inner case of the present safe can serve for shopping use. It can be further protected by adding a sturdy frame structure. It can also be mounted above the ground in the daytime and retracted under ground for safer protection at night.

d. It provides an alarm sounding device for warning use. This alarm system has a circuit connected to a numbering lock of the hydraulic means. Even though the thief may start the hydraulic pump, he canot open the the inner case unless he knows the number of the lock.

e. The numbering lock is composed of an annular element and a core element mounted for rotation therein. The lock dial is divided into 25 graduations. Hence, the possibility of opening the lock is $(1/25)^4$, and there is only one opportunity to open it through 391625 trials. Furthermore, the inner case cannot be raised if the oil passage is not clear. The alarm will also be sounding at this time.

f. The hydraulic oil pressure is generally around 70 $Kg/Cm^2$. It can raise an inner case weighing 300 Kg. The pressure is not so high that it normally would cause leakage or damage. If there is any leakage of oil, it can overflow to an oil tank.

g. Once this apparatus has been installed and used, it cannot be dismantled and/or disassembled. It's a low pressure device and it is difficult to break to oil tube. This equipment can be put into a room without influencing the decoration thereof.

Figure 1:
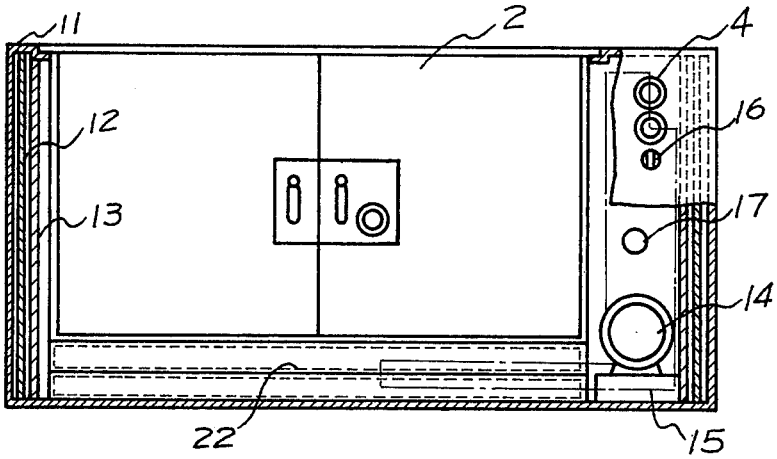
FIG. 1 is the assembly drawing of the preferred embodiment in accordance with the present invention.
Figure 1A:
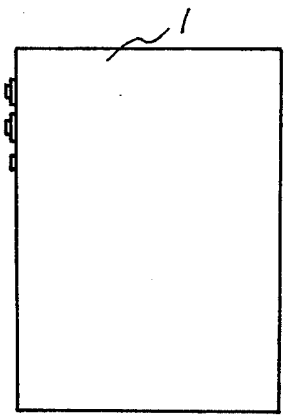
FIG. 1A is an end view of the assembly shown in FIG. 1
Figure 2:
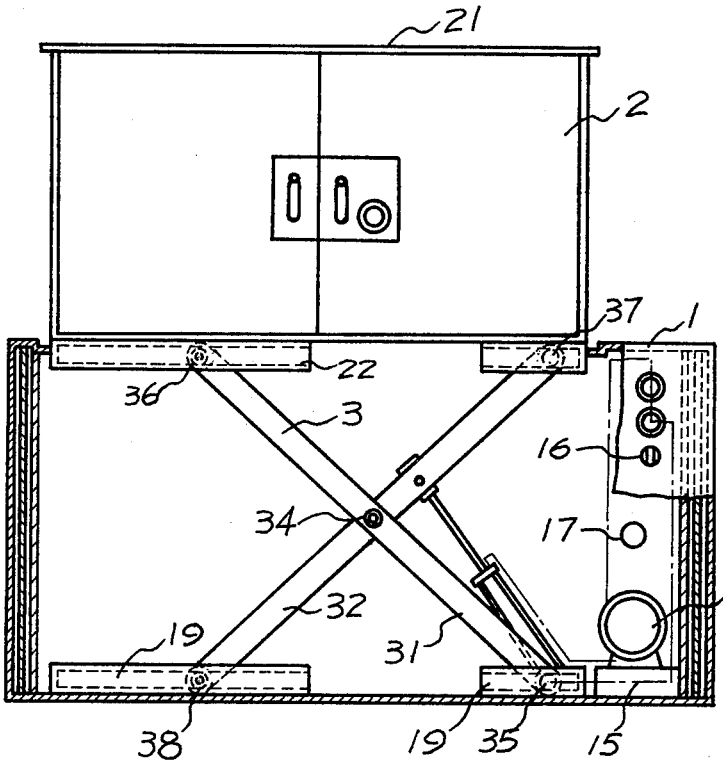
FIG. 2 is an elevation drawing as the inner case of the safe rises.
Figure 2A:
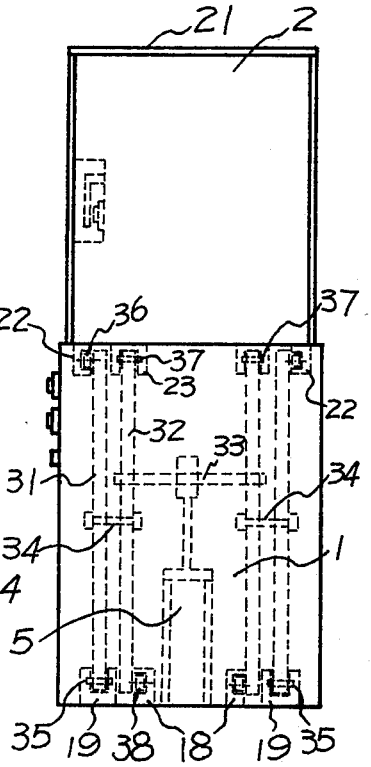

FIB. 2A is an end view of the assembly shown in FIG. 2

Figure 3:
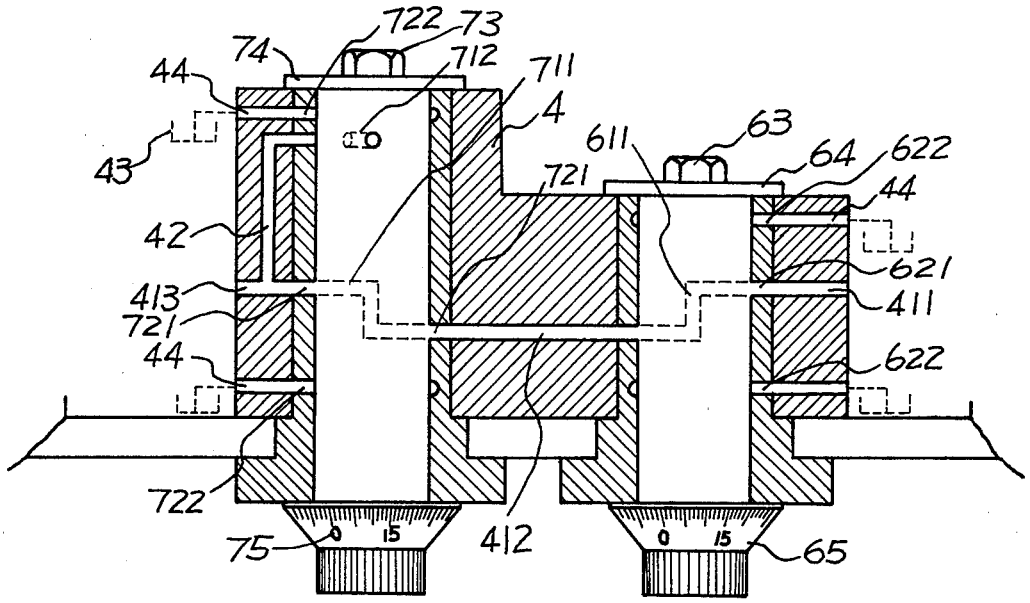

FIG. 3 is a drawing of the numbering lock bracket of the present embodiment.

Figure 4A:
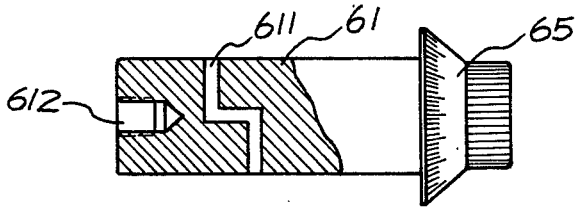
Figure 4:
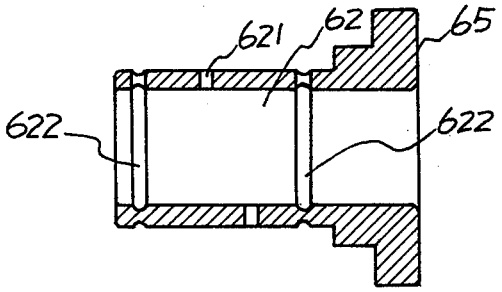

FIGS. 4 and 4A are the drawings of the first numbering lock.

Figure 5B:
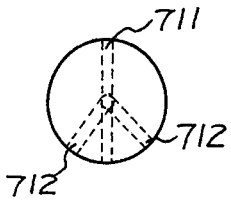
Figure 5A:
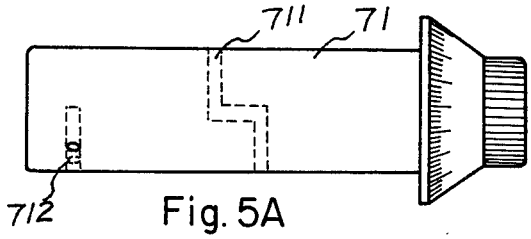
Figure 5C:
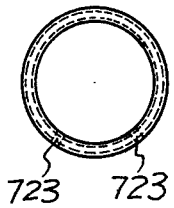
Figure 5:
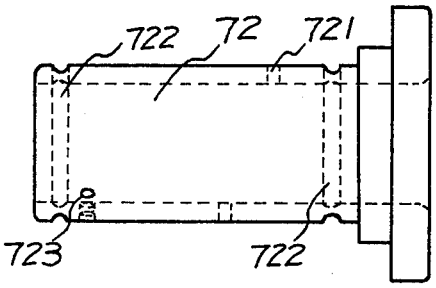

FIGS. 5, 5A, and 5c and the drawings of the second numbering lock.

Figure 6:
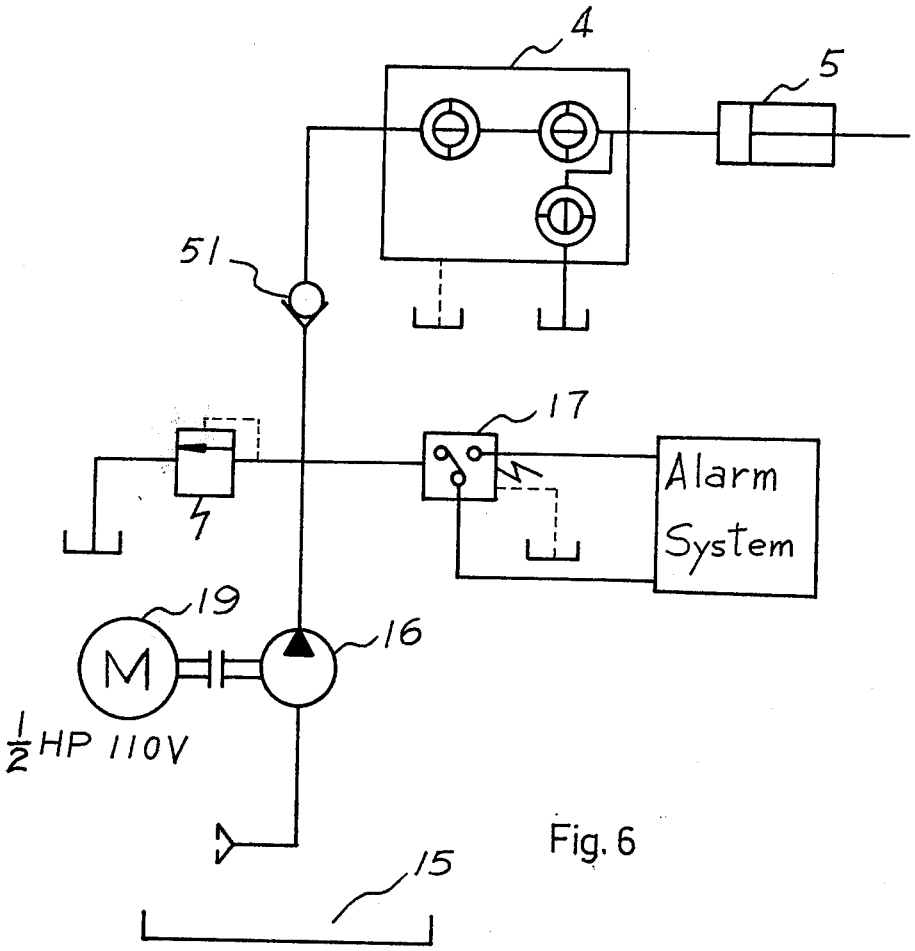

FIG. 6 relates to the hydraulic system according to the present invention.

DESCRIPTION OF THE PREFERRED EMBODIMENT

The preferred embodiment in accordance with the present invention is illustrated in detail as follows:

The outer casing body 1 is a hollow body. It is a closed structure except for the top which is an open surface. An inner casing 2 is inserted into casing 1. Casing 1 itself comprises: steel plate layer 11, fire retarding asbestos layer 12, and white cast iron layer 13.

Casing 1 is constructed as including: a ground gear 3, a hydraulic oil pump 14, an oil tank 15, a bottom rail 18, a bracket for number lock 4, a power switch lock 16, and a alarm and valve 17.

The inner case 2 is provided for storing precious materials, such as jewelry and is constructed and usually disposed by a glass window, the safe and the top binding materials being of steel plate, asbestos and white cast iron. Rail 22 and bracket 23 are provided for mounting ground gear 3.

As shown in FIG. 2, ground gear 3 is composed of outer framework 31, inner framework 32 and link 33. The outer framework 31 and inner framework 32 are linked by a pin 34 which serves as the pivot point for the frameworks. The outer framework 31 bottom is fixed on bracket 19 of casing 1 by a pin 35. The pin 35 will serve as a center about which the outer framework can rotate along it without any displacement change. The outer framework 31 top is fixed with roller 36; this allows the outer framework 31 to move in a slipping action along the rail 22 of the inner case. In a similar manner, the inner framework 32 top is fixed on bracket 23 of inner case 2 by a pin 37. The inner framework 32 can rotate along the center of the pin 37 without any displacement therefrom. A roller 38 is fixed on the bottom of inner framework 32 to cause slipping of the inner framework along rail 18 on the bottom of casing 1. A link 33 connecting these two inner frameworks is carried by a hydraulic cylinder 5 which is actuated by the hydraulic oil. The ground gear 3 can then be descended or risen to thereby move the inner case 2 upward or downward.

The bracket of number lock 4 is fixed on casing 1. This bracket 4 provides an assembly of a first numbering lock 6 and a second numbering lock 7. The bracket 4 itself contains hydraulic oil passages 411, 412, and 413, oil drainage passages 42, 43 and a overflow passage 44. (FIG. 3)

First numbering lock 6 (as shown in FIG. 4) itself comprises a core element 61 and an annular element 62. Hydraulic oil passages 611 and 612 are provided inside the core element 61; oil passage 621 and overflow passage 622 are provided in annular element 62. By fixing screw 63 and washer 64, the annular element and core element in combination will be assembled into bracket 4. The annular and core element each can be freely rotated within bracket 4. Mark 65 is set on the surface each of the annular and core element serving for a mesh mark.

The second numbering lock 7 (as shown in FIG. 5) is composed of a core element 71 and an annular element 72. Hydraulic oil passage 711, 721 and overflow passage 722 are provided thereon. There are further provided oil drainage passages 712, 723 on core element 71 and annular element 72 respectively. These oil drainage passages should be arranged not in series with oil passages 711 and 721. Screw 73 and washer 74 fix annular element 72 in any desired orientation to choose the combination which will raise the safe. Mark 75 is also set on the surface thereon for mesh.

The first numbering lock 6, second numbering lock 7 and bracket 4 (as in FIG. 3) are operated in the following manner. The hydraulic oil passes through passage 411 then leads into oil passage 621, 611 on the core and the annular element of the first numbering lock in mesh with oil passage 411, 412 of bracket 4. At this time, the number on mark 65 on the core and the annular element and the corresponding number on casing 1 are the precise number for opening the safe. The oil from the above-mentioned passage flows into passage 721, 711 on the core and annular element of second numbering lock which has been calibrated at the number and released from passage 413 to the hydraulic cylinder for doing work so as to raise the inner case 2. When lowering the inner case 2, the core element 71 and annular element 72 of the numbering lock are turned to meet a specific mark where oil drainage passages 712, 723 and 43 are in alignment with one another. The hydraulic oil in hydraulic cylinder 5 will spontaneously release from 42 through 723, 712 to 43 and return to oil tank 15 to thereby cause the case 2 to descend. Any leaking oil or overflow oil between the annular space and bracket will overflow through passage 44, 622, 722 and return to oil tank 15.

The present invention relates to an assembly where an inner case 2 is inserted into a casing 1, a living ground gear 3 is put between casing 1 and inner case 2. When opening the inner case 2, pre-adjust each numbering lock 61, 62, 71, 72 to a specific number to mesh with the oil passage among the core and annular element and bracket 4, insert the key into power switch lock 16 and open it to start the hydraulic oil pump; the oil will then be boosted into hydraulic cylinder 5 and elevate inner case 2 by raising the ground gear 3. The power will be automatically turned off when case 2 reaches its peak position. At this time, one can take or deposit something from or into the elevated casing which can also serve as a display case. When the oil is at its stable state, the inner case will not drop automatically. When trying to lower the case into a protective position, turn the mark on second numbering lock 7 to meet another specific number where the internal oil passages are in mesh with one another, so that the hydraulic oil withing hydraulic cylinder 5 will release through oil passages into oil tank 15 to thereby cause the inner case 2 to descend to its lower position.

It is impossible to mesh with oil passages among annular and core elements and bracket 4 if one has forgotten each specific number referred. If someone tries to start the hydraulic pump 14 even though a little deviation from mesh still exists, the oil pressure will rapidly increase and cause the alarm to sound by an oil alarm valve 17. (FIG. 6). This is because a pressure, e.g., 75 $Kg/Cm^2$, has been set for the alarm valve. Where the hydraulic oil will flow normally under 70 $Kg/Cm^2$ and cause no alarm sound when the number of numbering lock is correct. If the number is incorrect, this allows some deviation or blocking within the passages and causes the oil pressure to increase thereby causing the oil to flow through oil alarm valve 17 to tank 15 and actuating the electric circuit connected to alarm and sounding. Even if the power source is off, the hydraulic oil will not restore the case 2 to its elevated and stable position.

I claim:

1. A safe for protecting valuables comprising:

an outer casing having an open top, an inner casing for receiving said valuables, a linkage means within said outer casing for mounting said inner casing within said outer casing for movement between a lower, protected position within said outer case and a stable elevated position permitting entry into said inner casing, hydraulic means mounted within said outer casing and connected to said linkage means and defining a first hydraulic path for applying a force to elevate said inner casing to said elevated position and a second path permitting said inner casing to return to said lower position, a source of hydraulic fluid within said outer casing and connected to said hydraulic means for supplying hydraulic fluid under pressure to said hydraulic means, and first and second locks each includng a first rotatable and annular element and a second element rotatable within said first element and having a dial for rotating the same, each element having a first passage therethrough so that when said elements are rotated to a rise position in which said first passages are aligned whereby a first path is completed to elevate said inner casing and at least one of said element having an oil drain passage so that, when said one element is rotated to a lower position, the oil pressure is released and said inner case is lowered.

2. A safe as in claim 1, further including alarm means coupled to said first path for producing an alarm signal when the hydraulic pressure in said first path exceeds a predetermined level.

* * * * *